US011125491B2

(12) United States Patent
Allgeier et al.

(10) Patent No.: US 11,125,491 B2
(45) **Date of Patent: *Sep. 21, 2021**

(54) ADJUSTABLE SHELF ASSEMBLY FOR AN APPLIANCE

(71) Applicant: Haier US Appliance Solutions, Inc., Wilmington, DE (US)

(72) Inventors: Brian Allgeier, Louisville, KY (US); Stephanos Kyriacou, Lousiville, KY (US); Matthew Hunter, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 56 days.

This patent is subject to a terminal disclaimer.

(21) Appl. No.: 16/578,680

(22) Filed: Sep. 23, 2019

(65) Prior Publication Data

US 2021/0088270 A1 Mar. 25, 2021

(51) Int. Cl.

| | |
|---|---|
| ***F25D 25/02*** | (2006.01) |
| ***A47B 51/00*** | (2006.01) |
| ***F25D 25/04*** | (2006.01) |
| ***A47B 57/06*** | (2006.01) |

(52) U.S. Cl.

CPC ..... *F25D 25/024* (2013.01); *A47B 51/00* (2013.01); *A47B 57/06* (2013.01); *F25D 25/02* (2013.01); *F25D 25/04* (2013.01)

(58) Field of Classification Search

CPC ..... F25D 25/024; F25D 25/02; A47B 51/00; A47B 57/06; A47B 57/08

See application file for complete search history.

(56) References Cited

U.S. PATENT DOCUMENTS

| | | | | |
|---|---|---|---|---|
| 399,197 | A * | 3/1889 | Hawkins | B65G 1/07 312/306 |
| 2,813,635 | A * | 11/1957 | Schumacher | A47B 49/004 108/138 |
| 2,841,459 | A * | 7/1958 | Sharpe | A47B 57/06 312/306 |
| 2,978,113 | A * | 4/1961 | Anderson | A47B 51/00 108/141 |
| 3,172,715 | A * | 3/1965 | Powder | F25D 25/027 312/298 |
| 7,611,111 | B2 * | 11/2009 | Costa | A47B 57/00 108/147.17 |
| 8,485,618 | B2 * | 7/2013 | Benz | F24C 15/16 312/408 |

(Continued)

FOREIGN PATENT DOCUMENTS

KR 828713 B1 5/2008

*Primary Examiner* — Kimberley S Wright

(74) *Attorney, Agent, or Firm* — Dority & Manning, P.A.

(57) ABSTRACT

An appliance includes a cabinet and a shelf assembly. The shelf assembly includes a lead screw mounted to the cabinet such that the lead screw is rotatable. A shelf support is mounted to the cabinet such the shelf support is translatable relative to the lead screw. The shelf support has a housing. A nut is disposed within the housing of the shelf support and is threaded on the lead screw. The nut has a plurality of teeth at an outer surface of the nut. A locking plunger has at least one tooth. An actuator is coupled to the locking plunger. The actuator is operable to selectively mesh the at least one tooth of the locking plunger with the plurality of teeth of the nut.

18 Claims, 7 Drawing Sheets

(56) References Cited

U.S. PATENT DOCUMENTS

| | | | | |
|---|---|---|---|---|
| 8,746,819 | B2 * | 6/2014 | Donmez | F25D 25/02 312/408 |
| 10,314,393 | B2 * | 6/2019 | Abeygunawardana | A47B 57/42 |
| 10,627,156 | B2 * | 4/2020 | Kang | F25D 25/025 |
| 10,694,843 | B2 * | 6/2020 | Nuss | F25D 25/02 |
| 10,724,788 | B2 * | 7/2020 | Choi | F25D 25/022 |
| 11,002,478 | B2 * | 5/2021 | Kang | F25D 25/022 |
| 2008/0048081 | A1 * | 2/2008 | Costa | A47B 96/06 248/241 |
| 2009/0261704 | A1 * | 10/2009 | Benz | F25D 25/02 312/408 |
| 2018/0259245 | A1 * | 9/2018 | Abeygunawardana | F25D 25/04 |
| 2019/0075924 | A1 * | 3/2019 | Nuss | A47B 57/06 |
| 2019/0219324 | A1 * | 7/2019 | Kang | F25D 25/022 |
| 2019/0293340 | A1 * | 9/2019 | Choi | F25D 25/022 |
| 2020/0208908 | A1 * | 7/2020 | Kang | F25D 25/022 |
| 2020/0284502 | A1 * | 9/2020 | Choi | F25D 25/025 |

* cited by examiner

ADJUSTABLE SHELF ASSEMBLY FOR AN APPLIANCE

FIELD OF THE INVENTION

The present subject matter relates generally to adjustable shelves for appliances.

BACKGROUND OF THE INVENTION

Refrigerator appliances generally include a cabinet that defines a chilled chamber for receipt of food articles for storage. Refrigerator appliances can also include various internal storage components mounted within the chilled chamber and designed to facilitate storage of food items therein. Such storage components include racks, bins, shelves, and/or drawers that receive food items and assist with organizing and arranging of such food items within the chilled chamber. Certain conventional refrigerator appliances include adjustable shelves that can be moved from one shelf mounting position to another within the refrigerator appliance. In this manner, the configuration of shelves within the refrigerator can be selected to suit the user's needs.

Known refrigerator appliances include slotted tracks mounted on a rear wall of the appliance. Shelves with mounting supports engage slots in the slotted tracks such that a user may manually remove and reposition the shelf. However, movement of such shelves is labor intensive and time consuming. In particular, the user must remove all items on the shelf, pop the shelf out of the slotted track, and reposition the shelf before returning the removed items.

BRIEF DESCRIPTION OF THE INVENTION

Aspects and advantages of the invention will be set forth in part in the following description, or may be apparent from the description, or may be learned through practice of the invention.

In an example embodiment, an appliance includes a cabinet and a shelf assembly. The shelf assembly includes a lead screw mounted to the cabinet such that the lead screw is rotatable. A shelf support is mounted to the cabinet such the shelf support is translatable relative to the lead screw. The shelf support has a housing. A nut is disposed within the housing of the shelf support and is threaded on the lead screw. The nut has a plurality of teeth at an outer surface of the nut. A locking plunger has at least one tooth. An actuator is coupled to the locking plunger. The actuator is operable to selectively mesh the at least one tooth of the locking plunger with the plurality of teeth of the nut.

In another example embodiment, an appliance includes a cabinet and a shelf assembly. The shelf assembly includes a lead screw mounted to the cabinet such that the lead screw is rotatable. A first shelf support is mounted to the cabinet such the first shelf support is translatable relative to the lead screw. The first shelf support has a first housing. A first nut is disposed within the first housing and is threaded on the lead screw. The first nut has a plurality of teeth at an outer surface of the first nut. A first locking plunger has at least one tooth. A first actuator is coupled to the first locking plunger. The first actuator is operable to selectively mesh the at least one tooth of the first locking plunger with the plurality of teeth of the first nut. A second shelf support is mounted to the cabinet such the second shelf support is translatable relative to the lead screw. The second shelf support has a second housing. The second shelf support is separate from the first shelf support on the cabinet. A second nut is disposed within the second housing and is threaded on the lead screw. The second nut has a plurality of teeth at an outer surface of the second nut. A second locking plunger has at least one tooth. A second actuator is coupled to the second locking plunger. The second actuator is operable to selectively mesh the at least one tooth of the second locking plunger with the plurality of teeth of the second nut.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
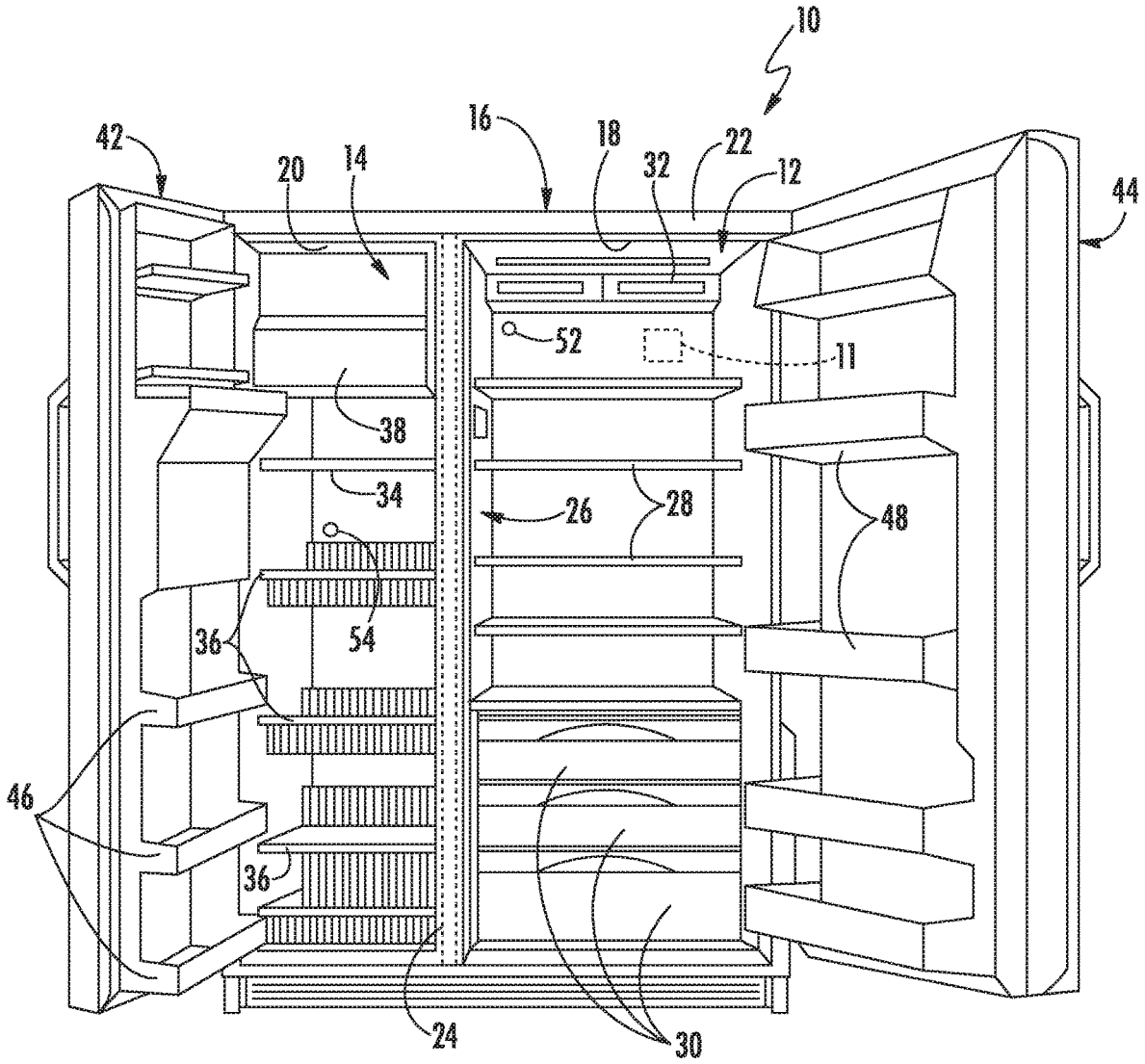
FIG. 1 is a front perspective view of a refrigerator appliance according to an example embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a representative refrigerator appliance 10 according to an example embodiment of the present disclosure. More specifically, for illustrative purposes, the present disclosure is described in the context of a refrigerator appliance 10 having a construction as shown and described further below. As used herein, a refrigerator appliance includes appliances such as a refrigerator/freezer combination, side-by-side, bottom mount, compact, and any other style or model of refrigerator appliance. Accordingly, other configurations including multiple and different styled compartments may be used with refrigerator appliance 10, it being understood that the configuration shown in FIG. 1 is provided by way of example only.

Refrigerator appliance 10 includes a fresh food storage compartment 12 and a freezer storage compartment 14. In this embodiment, freezer compartment 14 and fresh food compartment 12 are arranged side-by-side within an outer case 16 and defined by inner liners 18 and 20 therein. A space between case 16 and liners 18, 20 and between liners 18, 20 may be filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel. Outer case 16 and liners 18, 20 may collectively form a housing or casing of refrigerator appliance 10.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

Refrigerator appliance 10 can be operated by one or more controllers 11 or other processing devices according to programming or user preference via manipulation of a control interface 32 mounted (e.g., in an upper region of fresh food storage compartment 12 and connected with controller 11). Controller 11 may include one or more memory devices (e.g., non-transitive memory) and one or more microprocessors, such as a general or special purpose microprocessor operable to execute programming instructions or micro-control code associated with the operation of the refrigerator appliance 10. The memory may represent random access memory such as DRAM, or read only memory such as ROM or FLASH. In one embodiment, the processor executes programming instructions stored in memory. The memory may be a separate component from the processor or may be included onboard within the processor. Controller 11 may include one or more proportional-integral ("PI") controllers programmed, equipped, or configured to operate the refrigerator appliance according to various control methods. Accordingly, as used herein, "controller" includes the singular and plural forms.

Controller 11 may be positioned in a variety of locations throughout refrigerator appliance 10. In the illustrated embodiment, controller 11 may be located, for example, behind an interface panel 32 or doors 42 or 44. Input/output ("I/O") signals may be routed between the control system and various operational components of refrigerator appliance 10 along wiring harnesses that may be routed through, for example, the back, sides, or mullion 26. Typically, through user interface panel 32, a user may select various operational features and modes and monitor the operation of refrigerator appliance 10. In one embodiment, the user interface panel 32 may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. User interface panel 32 may be in communication with controller 11 via one or more signal lines or shared communication busses.

In some embodiments, one or more temperature sensors are provided to measure the temperature in the fresh food compartment 12 and the temperature in the freezer compartment 14. For example, first temperature sensor 52 may be disposed in the fresh food compartment 12 and may measure the temperature in the fresh food compartment 12. Second temperature sensor 54 may be disposed in the freezer compartment 14 and may measure the temperature in the freezer compartment 14. This temperature information can be provided (e.g., to controller 11 for use in operating refrigerator 10). These temperature measurements may be taken intermittently or continuously during operation of the appliance or execution of a control system.

Optionally, a shelf 34 and wire baskets 36 may be provided in freezer compartment 14. Additionally or alternatively, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. In alternative embodiments, one or both doors 42, 44 may be slidable or otherwise movable between open and closed positions. Freezer door 42 includes a plurality of storage shelves 46, and fresh food door 44 includes a plurality of storage shelves 48.

Figure 2:
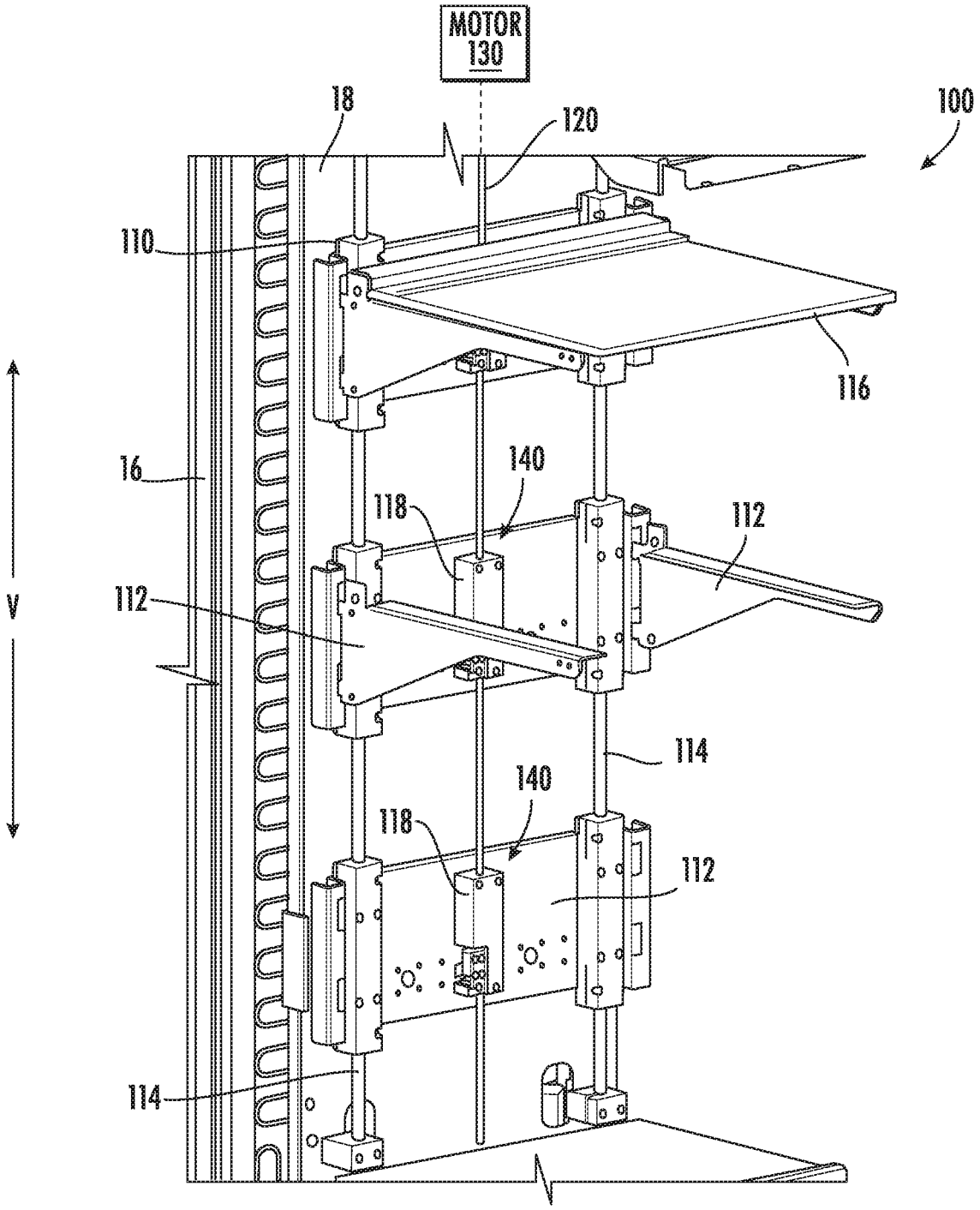
FIGS. 2 and 3 are partial perspective views of a shelf assembly of the example refrigerator appliance of FIG. 1.
Figure 3:
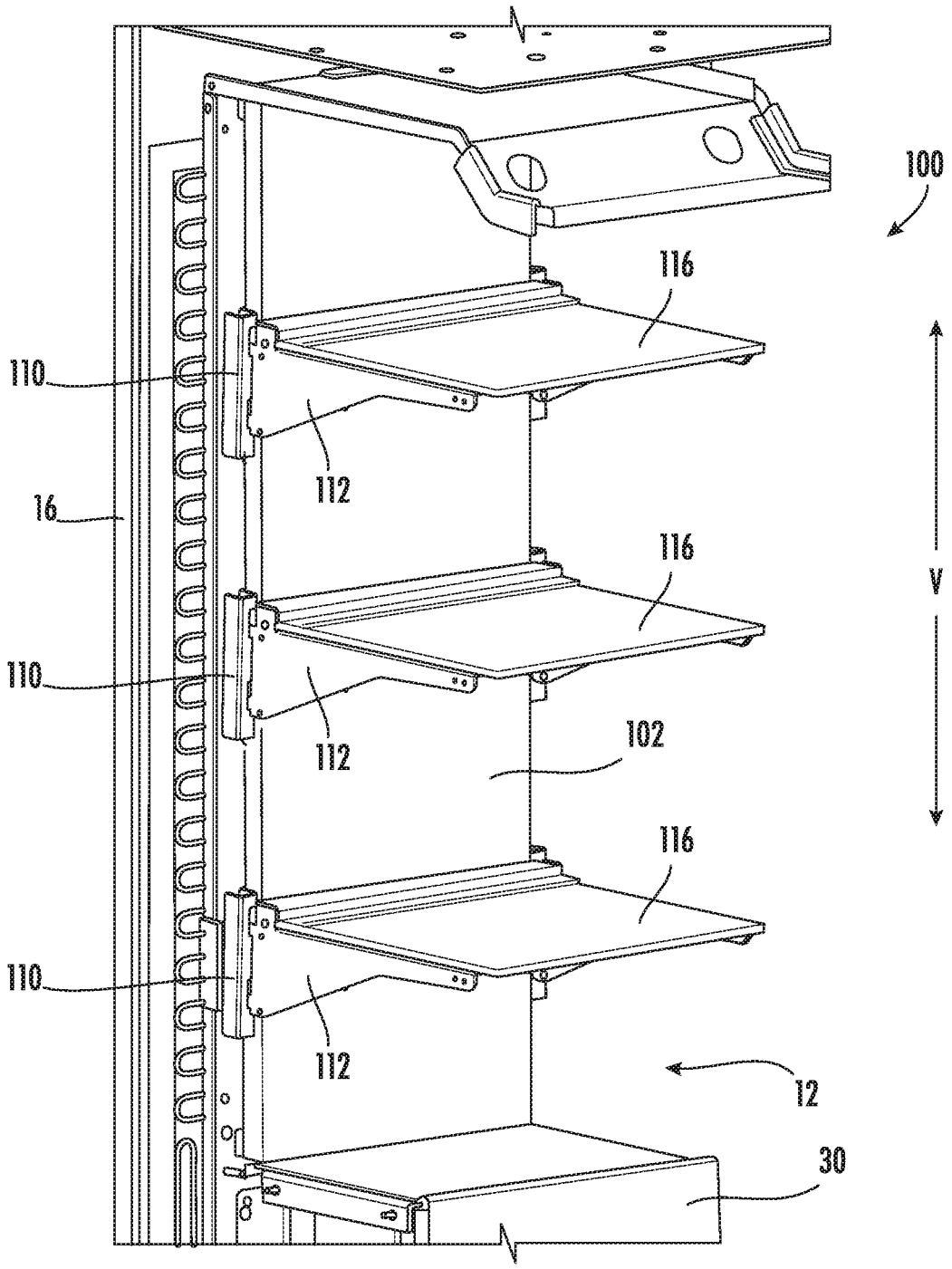

FIGS. 2 and 3 are partial perspective views of a shelf assembly 100 of refrigerator appliance 10. While described in greater detail below in the context of refrigerator appliance 10, it will be understood that shelf assembly 100 may be used in any suitable appliance in alternative example embodiments. For example, shelf assembly 100 may be used in a top-mount refrigerator appliance, a bottom-mount refrigerator appliance, a stand-alone freezer appliance, etc. As discussed in greater detail below, shelf assembly 100 includes features for motorized movement of shelves 110, such as shelves 28. In particular, shelf assembly 100 may be operable to selectively move one or more of shelves 110 with a single motor.

In FIG. 3, shelf assembly 100 is shown with a cover 102. Cover 102 may face fresh food storage compartment 12, e.g., and may form a portion of liner 18. Cover 102 may overlay various internal components of shelf assembly 100, as shown in FIG. 2 in which cover 102 is removed. Thus, e.g., the motorized components of shelf assembly 100 may be hidden behind cover 102 to improve a cosmetic appearance of shelf assembly 100. With reference to FIG. 3, shelf assembly 100 includes a plurality of shelves 110. Shelves 110 are moveable along a vertical direction V within fresh food storage compartment 12.

Turning to FIG. 2, shelf assembly 100 also includes a lead screw 120. Lead screw 120 is mounted within fresh food storage compartment 12 such that lead screw 120 is rotatable. For example, shelf assembly 100 may include a motor 130 (shown schematically in FIG. 2) coupled to lead screw 120, and motor 130 may be operable to rotate lead screw 120. Motor 130 may be positioned at a top or bottom of lead screw 120. By rotating lead screw 120, motor 130 may move one or more of shelves 110, e.g., along the vertical direction V, within fresh food storage compartment 12.

Each shelf 110 may include a shelf support or bracket 112. Shelf support 112 may be mounted on a track 114, e.g., that restrains movement of shelf support 112 to along the vertical direction V. Thus, shelf support 112 may translate along the vertical direction V in fresh food storage compartment 12 (or freezer compartment 14 in alternative example embodiments). Each shelf 110 may also include a panel 116 positioned on shelf support 112. Panel 116 may be removable from shelf support 112, e.g., to facilitate cleaning of panel 116. Various food items may be stored on panels 116. In FIG. 2, each shelf 110 includes two shelf supports 112. In alternative example embodiments, each shelf 110 may include one, three, or more shelf supports 112.

Shelf assembly 100 also includes a plurality of clutches 140. Each clutch 140 may mounted to a respective shelf support 112. Each clutch 140 may also be selectively opened and closed to connect the respective shelf support 112 to lead screw 120. When the clutch 140 is closed, the respective shelf support 112 is coupled to lead screw 120 such that rotation of lead screw 120 by motor 130 moves the respective shelf support 112 along the vertical direction V. Conversely, when the clutch 140 is opened, the respective shelf support 112 is disconnected from lead screw 120 such that rotation of lead screw 120 by motor 130 does not move the respective shelf support 112 along the vertical direction V. Thus, clutches 140 may regulate vertical movement of shelves 110.

In FIG. 2, shelf assembly 100 includes three shelves 110. It will be understood that this is provided by way of example only. In alternative example embodiments, shelf assembly 100 may include one, two, four, or more shelves 110. One, two, or all three of clutches 140 in FIG. 2 may be closed to move the respective shelf support 112 along the vertical direction V by rotating lead screw 120 with motor 130. Conversely, one, two, or all three of clutches 140 in FIG. 2 may be opened to keep the respective shelf support 112 at a fixed position along the vertical direction V despite rotation of lead screw 120 with motor 130. As may be seen from the above, one, two, or all three of shelves 110 may be vertically moved with motor 130 by selectively closing the respective clutch 140. Thus, only one motor 130 may be used to move only one shelf 110 or to move two/three of shelves 110 simultaneously.

Figure 4:
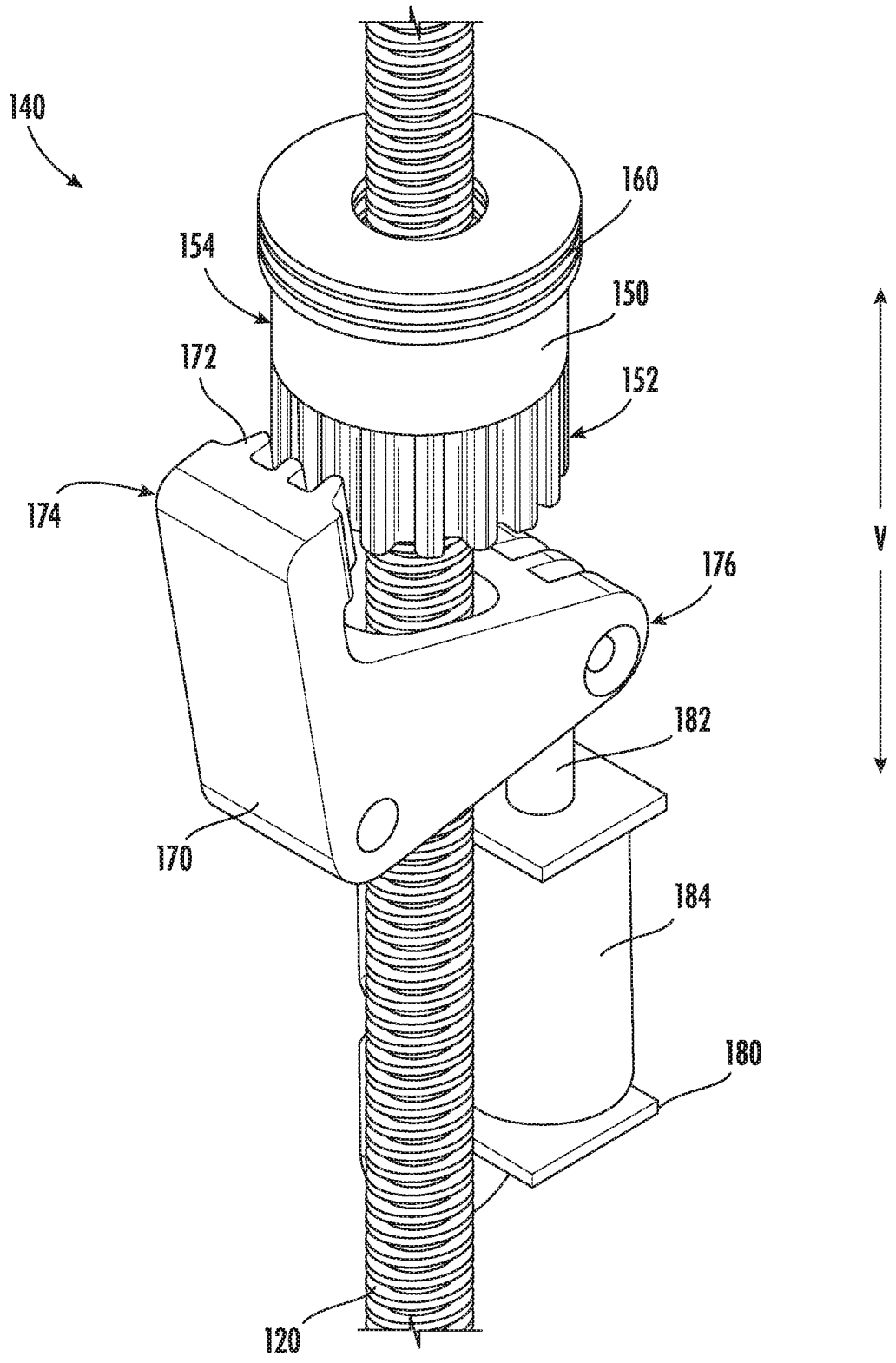
FIG. 4 is a perspective view of a clutch and lead screw of the shelf assembly of FIG. 3.
Figure 5:
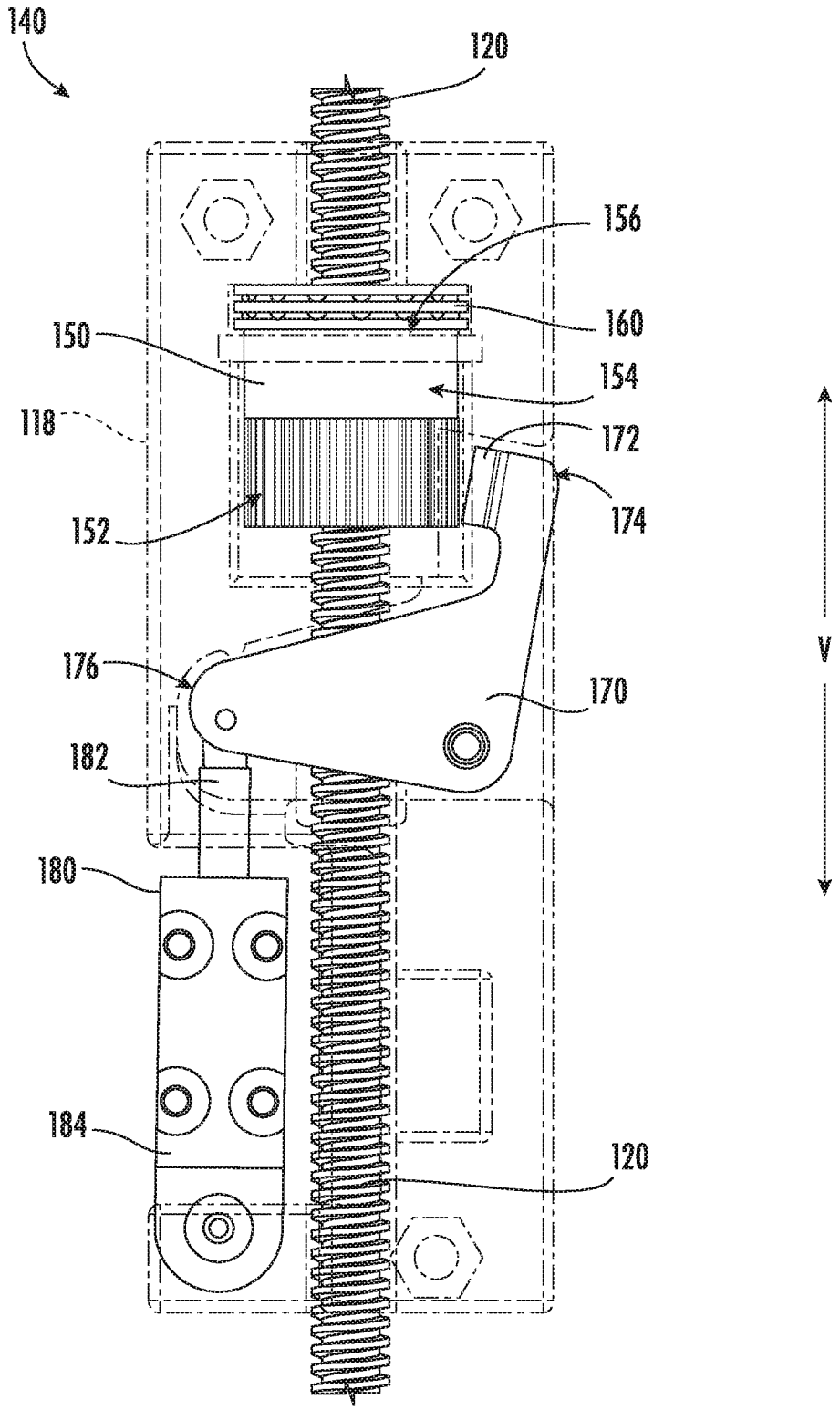
FIG. 5 is an elevation view of the clutch of FIG. 4 positioned within a housing of the shelf assembly.
Figure 6:
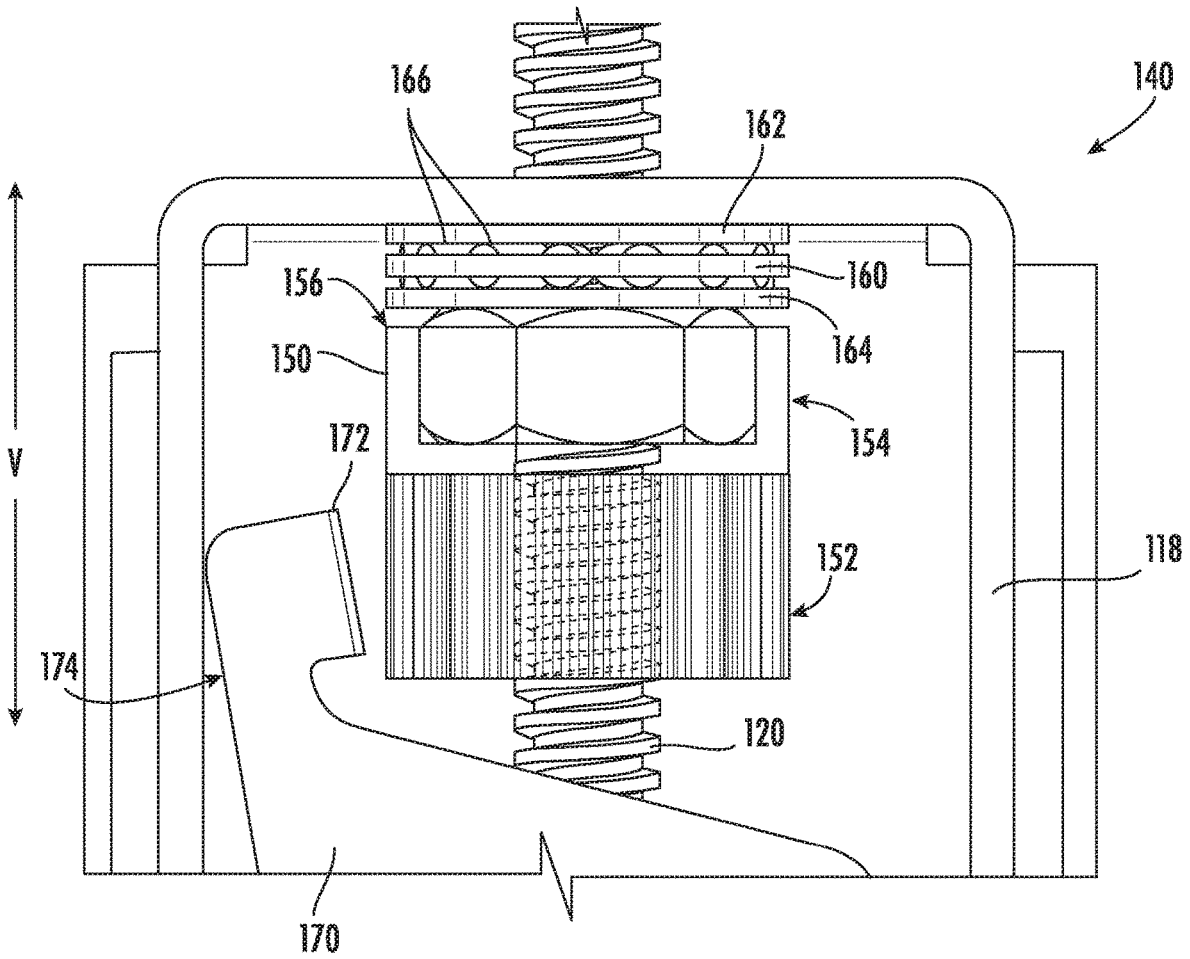
FIG. 6 is a partial elevation view of the clutch of FIG. 5.

FIG. 4 is a perspective view of clutch 140 and lead screw 120. FIG. 5 is an elevation view of clutch 140. FIG. 6 is a partial elevation view of clutch 140. With reference to FIGS. 2 and 5, shelf support 112 includes a housing 118. Housing 118 may be fixed relative to panel 116 when panel 116 is positioned on shelf support 112. Housing 118 contains various components of clutch 140, as discussed in greater detail below.

With reference to FIGS. 4 through 6, clutch 140 includes a nut 150, a bearing assembly 160, a locking plunger 170 and an actuator 180. Nut 150 is disposed within housing 118 and is threaded on lead screw 120. Thus, e.g., an inner threaded surface of nut 150 may be engaged with an outer threaded surface of lead screw 120. Nut 150 has a plurality of teeth 152 at an outer surface 154 of nut 150. Teeth 152 may be circumferentially distributed on outer surface 154 of nut 150 and/or may extend axially along outer surface 154 of nut 150.

Bearing assembly 160 is positioned between a top 156 of nut 150 and housing 118. Thus, e.g., bearing assembly 160 may be positioned within housing 118 and may extend between nut 150 and housing 118. In addition, lead screw 120 may extend through bearing assembly 160, e.g., within housing 118. Bearing assembly 160 assists with allowing nut 150 to rotate within housing 118. For example, bearing assembly 160 may include a first washer 162, a second washer 164 and a plurality of bearings 166. First washer 162 is positioned on or against housing 118, and second washer 164 is positioned on or against nut 150. Bearings 166 are positioned between and ride on first and second washers 162, 164. Thus, bearings 166 may roll on first and second washers 162, 164 to facilitate rotation of nut 150 relative to housing 118. Bearings 166 may be roller bearings in certain example embodiments, and may be connected to on another with a race. Bearings 166 may also be circumferentially distributed about lead screw 120 between first and second washers 162, 164.

Locking plunger 170 has at least one tooth 172, e.g., that is commentary to teeth 152 of nut 150, and actuator 180 is coupled to locking plunger 170. Actuator 180 is operable to selectively mesh the at least one tooth 172 of locking plunger 170 with teeth 152 of nut 150. For example, locking plunger 170 may be pivotally mounted to housing 118, and actuator 180 may pivot locking plunger 170 on housing 118 to selectively mesh the at least one tooth 172 of locking plunger 170 with teeth 152 of nut 150.

Locking plunger 170 may have a first end portion 174 and a second end portion 174, and locking plunger 170 may be pivotally mounted to housing 118 between first and second end portions 174, 176 of locking plunger 170. The at least one tooth 172 of locking plunger 170 may be positioned at first end portion 174 of locking plunger 170, and locking plunger 170 may be coupled to actuator 180 at second end portion 176 of locking plunger 170. Locking plunger 170 may be L-shaped between first and second end portions 174, 176 of locking plunger 170.

Actuator 180 may be a solenoid, such as a direct current pull solenoid. Thus, e.g., actuator 180 may have a plunger 182 and a casing 184. One of plunger and casing 182, 184 of solenoid 180 may be positioned at and connected to second end portion 176 of locking plunger 170, and the other of plunger and casing 182, 184 of solenoid 180 may be positioned at and connected to housing 118. In alternative example embodiments, actuator 180 may be a shape-memory alloy, a linear actuator, etc.

By meshing the at least one tooth 172 of locking plunger 170 with teeth 152 of nut 150, rotation of nut 150 relative to lead screw 120 may be regulated. For example, nut 150 may be fixed relative to lead screw 120 when actuator 180 does not mesh the at least one tooth 172 of locking plunger 170 with teeth 152 of nut 150. Thus, e.g., when motor 130 rotates lead screw 120, nut 150 may rotate with lead screw 120 such that the position of shelf support 112 along the vertical direction V does not change (or insubstantially changes) despite rotation of lead screw 120 with motor 130. In contrast, nut 150 is rotatable relative to lead screw 120 when actuator 180 meshes the at least one tooth 172 of locking plunger 170 with teeth 152 of nut 150. Thus, e.g., when motor 130 rotates lead screw 120, nut 150 may rotate relative to lead screw 120 such that the position of shelf support 112 along the vertical direction V changes due to the rotation of lead screw 120. In such a manner, clutches 140 may regulate vertical movement of shelves 110.

As may be seen from the above, shelf assembly 100 may advantageously provide fully adjustable, automatic height control for shelves 110 within refrigerator appliance 10. Shelf assembly 100 utilizes clutches 140 to engage a respective shelf 110 to lead screw 120. For each shelf 110, actuator 180 may mesh the at least one tooth 172 of locking plunger 170 with teeth 152 of nut 150 in order to prevent rotation of nut 150. Nut 150 is thus driven up or down on lead screw 120, which forces the engaged shelf 110 up or down, depending on the rotational direction of lead screw 120. All shelves 110 whose nuts 150 are not engaged during rotation of lead screw 120 are kept vertically in place. No vertical movement of such shelves 110 occurs because the weight of the shelf 110 rests on bearing assembly 160 which transfers the weight to nut 150, thus allowing nut 150 to rotate in correspondence with lead screw 120 due to the greater friction within the thread coupling between nut 150 and lead screw 120 than that within bearing assembly 160.

Figure 7:
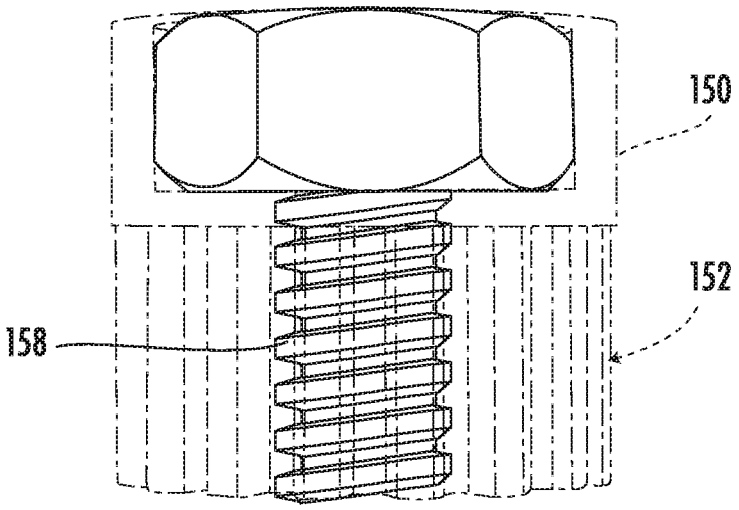
FIG. 7 is an elevation view of a nut of the clutch of FIG. 5 with a direct interfering thread.
Figure 8:
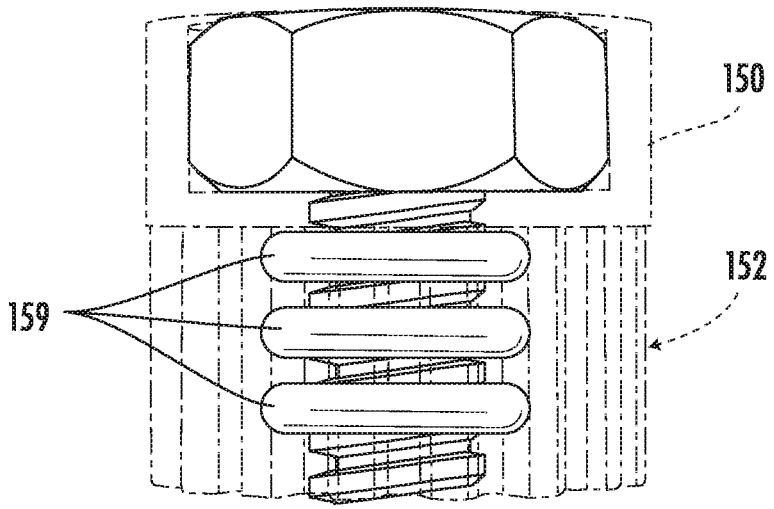
FIG. 8 is an elevation view of a nut according to another example embodiment with a nylon seal.

Clutches 140 may also include additional features for discouraging rotation of nut 150 on lead screw 120 when actuator 180 does not mesh the at least one tooth 172 of locking plunger 170 with teeth 152 of nut 150. As shown in FIG. 7, nut 150 may include a direct interfering thread 158 on at least a portion of the thread coupling between nut 150 and lead screw 120. Direct interfering thread 158 forms a slight interference fit between nut 150 and lead screw 120, e.g., due to an oversized root diameter of lead screw 120 relative to nut 150, that discourages rotation of nut 150 on lead screw 120 when actuator 180 does not mesh the at least one tooth 172 of locking plunger 170 with teeth 152 of nut 150. As another example, nut 150 may include a nylon seal 159, such as a Nyloc-inspired ring, that contacts lead screw 120. As may be seen from the above, nut 150 may include drag-inducing such as additional plastic threads, Nyloc-inspired rings, etc. to further bias a disengaged nut 150 to rotate with lead screw 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:
- a cabinet; and
- a shelf assembly comprising
  - a lead screw mounted to the cabinet such that the lead screw is rotatable,
  - a motor coupled to the lead screw, the motor operable to rotate the lead screw,
  - a shelf support mounted to the cabinet such the shelf support is translatable relative to the lead screw, the shelf support having a housing,
  - a nut disposed within the housing of the shelf support and threaded on the lead screw, the nut having a plurality of teeth at an outer surface of the nut,
  - a locking plunger having at least one tooth, and
  - an actuator coupled to the locking plunger, the actuator operable to selectively mesh the at least one tooth of the locking plunger with the plurality of teeth of the nut.

2. The appliance of claim 1, wherein the nut is fixed relative to the lead screw when the motor operates to rotate the lead screw and the actuator does not mesh the at least one tooth of the locking plunger with the plurality of teeth of the nut, and the nut rotates relative to the lead screw when the motor operates to rotate the lead screw and the actuator meshes the at least one tooth of the locking plunger with the plurality of teeth of the nut.

3. The appliance of claim 1, wherein the actuator is a solenoid.

4. The appliance of claim 1, further comprising a bearing assembly positioned between a top of the nut and the housing of the shelf support, wherein the lead screw extends through the bearing assembly.

5. The appliance of claim 4, wherein the bearing assembly comprises:
- a first washer positioned on the housing;
- a second washer positioned on the nut; and
- a plurality of bearings positioned between and riding on the first and second washers.

6. The appliance of claim 5, wherein the plurality of bearings is a plurality of roller bearings.

7. The appliance of claim 1, wherein the locking plunger is pivotally mounted to the housing.

8. The appliance of claim 7, wherein the locking plunger had a first end portion and a second end portion, the locking plunger is pivotally mounted to the housing between the first and second end portions of the locking plunger, the at least one tooth of the locking plunger is positioned at the first end portion of the locking plunger, and the locking plunger is coupled to the actuator at the second end portion of the locking plunger.

9. The appliance of claim 8, wherein the actuator is a solenoid having a plunger and a casing, one of the plunger and the casing of the solenoid is positioned at and connected to the second end portion of the locking plunger, and the other of the plunger and the casing of the solenoid is positioned at and connected to the housing.

10. The appliance of claim 1, wherein the nut defines an internal threaded surface, at least a portion of the internal threaded surface of the nut forming a direct interfering thread with the lead screw.

11. The appliance of claim 1, wherein the nut comprises at least one nylon seal that contacts the lead screw.

12. The appliance of claim 1, wherein the shelf assembly further comprises a panel mounted on the shelf support.

13. An appliance, comprising:
- a cabinet; and
- a shelf assembly comprising
  - a lead screw mounted to the cabinet such that the lead screw is rotatable,
  - a motor coupled to the lead screw, the motor operable to rotate the lead screw,
  - a first shelf support mounted to the cabinet such the first shelf support is translatable relative to the lead screw, the first shelf support having a first housing,
  - a first nut disposed within the first housing and threaded on the lead screw, the first nut having a plurality of teeth at an outer surface of the first nut,
  - a first locking plunger having at least one tooth,
  - a first actuator coupled to the first locking plunger, the first actuator operable to selectively mesh the at least one tooth of the first locking plunger with the plurality of teeth of the first nut,
  - a second shelf support mounted to the cabinet such the second shelf support is translatable relative to the lead screw, the second shelf support having a second housing, the second shelf support separate from the first shelf support on the cabinet, a second nut disposed within the second housing and threaded on the lead screw, the second nut having a plurality of teeth at an outer surface of the second nut, a second locking plunger having at least one tooth, and a second actuator coupled to the second locking plunger, the second actuator operable to selectively mesh the at least one tooth of the second locking plunger with the plurality of teeth of the second nut.

14. The appliance of claim 13, wherein the first nut is fixed relative to the lead screw when the motor operates to rotate the lead screw and the first actuator does not mesh the at least one tooth of the first locking plunger with the plurality of teeth of the first nut, and the first nut rotates relative to the lead screw when the motor operates to rotate the lead screw and the first actuator meshes the at least one tooth of the first locking plunger with the plurality of teeth of the first nut.

15. The appliance of claim 13, further comprising:

a first bearing assembly positioned between a top of the first nut and the first housing; and a second bearing assembly positioned between a top of the second nut and the second housing, wherein the lead screw extends through the first and second bearing assemblies.

16. The appliance of claim 15, wherein the first bearing assembly comprises:

a first washer positioned on the first housing;

a second washer positioned on the first nut; and a plurality of bearings positioned between and riding on the first and second washers.

17. The appliance of claim 13, wherein the first nut defines an internal threaded surface, at least a portion of the internal threaded surface of the first nut forming a direct interfering thread with the lead screw.

18. The appliance of claim 13, wherein the first nut comprises at least one nylon seal that contacts the lead screw.

* * * * *